US010328434B2

(12) United States Patent
Yin et al.

(10) Patent No.: US 10,328,434 B2
(45) Date of Patent: Jun. 25, 2019

(54) METHOD AND APPARATUS FOR FRACTURING POLYCRYSTALLINE SILICON

(71) Applicant: Xinte Energy Co., LTD., Urumqi, Xinjiang (CN)

(72) Inventors: Bo Yin, Xinjiang (CN); Guangjian Hu, Xinjiang (CN); Xiqing Chen, Xinjiang (CN); Bin Huang, Xinjiang (CN); Guilin Liu, Xinjiang (CN)

(73) Assignee: XINTE ENERGY CO., LTD, Urumqi (CN)

( * ) Notice: Subject to any disclaimer, the term of this patent is extended or adjusted under 35 U.S.C. 154(b) by 1027 days.

(21) Appl. No.: 14/428,335

(22) PCT Filed: Sep. 16, 2013

(86) PCT No.: PCT/CN2013/083545
§ 371 (c)(1),
(2) Date: Mar. 13, 2015

(87) PCT Pub. No.: WO2014/044156
PCT Pub. Date: Mar. 27, 2014

(65) Prior Publication Data

US 2015/0231642 A1 Aug. 20, 2015

(30) Foreign Application Priority Data

Sep. 18, 2012 (CN) ..... 2012 1 0346137

(51) Int. Cl.
*B02C 19/00* (2006.01)
*B02C 19/18* (2006.01)

(52) U.S. Cl.
CPC ..... *B02C 19/18* (2013.01); *B02C 2019/183* (2013.01)

(58) Field of Classification Search
CPC ..... B02C 19/18; B02C 2019/183
(Continued)

(56) References Cited

U.S. PATENT DOCUMENTS

| | | | |
|---|---|---|---|
| 5,464,159 | A | 11/1995 | Wolf et al. |
| 6,360,755 | B1 | 3/2002 | Schantz et al. |
| 2012/0132731 | A1 | 5/2012 | Bentaj et al. |

FOREIGN PATENT DOCUMENTS

| | | |
|---|---|---|
| CN | 1209034 | 2/1999 |
| CN | 102836765 | 12/2012 |

(Continued)

OTHER PUBLICATIONS

Authorized Officer Huang, Jun, "International Search Report" dated Dec. 26, 2013. PCT/CN2013/083545. 5 Pages; English Translation Version Attached. 3 Pages.

(Continued)

*Primary Examiner* — Faye Francis
(74) *Attorney, Agent, or Firm* — Stetina Brunda Garred and Brucker

(57) ABSTRACT

The present invention provides a method and an apparatus for fracturing polycrystalline silicon, and the method includes steps of placing the polycrystalline silicon in a water tank containing water; applying an instant high voltage to the water tank so that high-voltage discharge occurs in the water of the water tank to fracture the polycrystalline silicon. The method and apparatus have advantages of simple process, uniform fragments and no metal contamination.

11 Claims, 1 Drawing Sheet

(58) Field of Classification Search
USPC ..... 241/1, 301
See application file for complete search history.

(56) References Cited

FOREIGN PATENT DOCUMENTS

| | | |
|---|---|---|
| CN | 202845134 | 4/2013 |
| DE | 3035131 | 4/1982 |
| DE | 4218283 | 12/1993 |
| DE | 19834447 | 2/2000 |
| DE | 102008033122 | 1/2010 |
| JP | 2000233138 | 8/2000 |
| KR | 1020020076521 | 10/2002 |
| KZ | 19405 B | 11/2010 |
| RU | 2278733 | 6/2006 |
| RU | 116073 | 5/2012 |

OTHER PUBLICATIONS

Unknown "Written Opinion of the International Searching Authority" dated Dec. 26, 2013. PCT/CN2013/083545. 6 Pages. English Translation Version Attached. 11 Pages.
Unknown "Chinese Office Action" dated Feb. 2, 2014. CN20131083545. 6 Pages.
"Chinese Office Action" dated Feb. 8, 2014. Application No. 201210346173.3. 6 Pages; English Translation Version Attached. 13 Pages. (19 Pages Total).
Examiner Su-Hyeong Kim, "Notification of Reason for Refusal," Dated Feb. 3, 2016, Application No. KR 10-2015-7008232, 6 pages, Korean Intellectual Property Office, South Korea, English translation attached, 5 pages (11 pages total).
Korean Patent Examiner, "Official Notice for Filing Response," Dated Feb. 27, 2017, Application No. KR 10-2016-7033677, 3 pages, Korean Intellectual Property Office, South Korea, English translation attached, 2 pages (5 pages total).
Korean Patent Examiner, "Official Notice for Filing Response," Dated Aug. 10, 2017, Application No. KR 10-2016-7033677, 3 pages, Korean Intellectual Property Office, South Korea, English translation attached, 2 pages (5 pages total).
Chinese Patent Examiner, "The Second Office Action," Application No. CN 201210346137.3, 3 pages, The State Intellectual Property Office of People's Republic of China, China, English translation attached, 5 pages (8 pages total) May 30, 2014.
Dr. Elmar Spieleder, "Examination Report," Dated Aug. 24, 2016, Application No. DE 11 2013 004 071.9, 6 pages, German Patent and Trademark Office, Germany, English translation attached, 8 pages (14 pages total).
O.A. Guseva, "Official Action of substantive examination," Dated Jun. 16, 2016, Application No. RU 2015114573, 7 pages, Federal Institute of Industrial Property, Moscow, Russia, English translation attached, 6 pages (13 pages total).

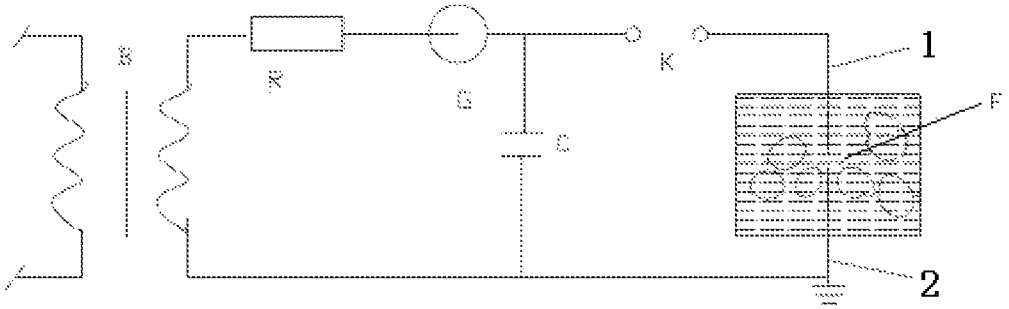
B
R
G
C
K
1
F
2

METHOD AND APPARATUS FOR FRACTURING POLYCRYSTALLINE SILICON

CROSS-REFERENCE TO RELATED APPLICATIONS

The present application claims priority to International Application No. PCT/CN2013/083545 which was filed on Sep. 16, 2013 and claims priority to Chinese Patent Application No. 201210346137.3 filed Sep. 18, 2012.

STATEMENT RE: FEDERALLY SPONSORED RESEARCH/DEVELOPMENT

Not Applicable

FIELD OF THE INVENTION

The present invention relates to the field of polycrystalline silicon fracturing technology, and particularly to a method for fracturing polycrystalline silicon and an apparatus for fracturing polycrystalline silicon.

BACKGROUND OF THE INVENTION

With gradual exhaustion of fossil fuel and increasingly serious environmental pollution, it is imperative to seek for a nonpolluting, renewable energy. Making the best of solar energy is of great economic and strategic significance to achieve sustainable development in low-carbon model. Polycrystalline silicon is the main raw material for fabricating solar photovoltaic cells. Fracturing polycrystalline silicon, as the last production procedure for a polycrystalline silicon production enterprise, is directly associated with the quality of polycrystalline silicon and enterprise benefit.

Recently, in most polycrystalline silicon production enterprises, polycrystalline silicon is fractured by using mechanically fracturing methods which can be classified into manually fracturing methods and automatically fracturing method. In a manually fracturing method, polycrystalline silicon is smashed with a hammer (or other rigid tools) and then screened and packaged. In an automatically fracturing method, polycrystalline silicon is crushed by a mechanical fracturing apparatus (e.g. jaw crusher, impact crusher, and the like). In the above two methods, polycrystalline silicon is fractured due to the pressure generated by a mechanical collision between a tool for fracturing and the polycrystalline silicon to be fractured, and both methods suffer from the disadvantages as below.

1. The mechanical collision between the tool for fracturing and the polycrystalline silicon to be fractured inevitably causes metal contamination, particularly iron contamination which significantly reduces the lifetime of minority carrier of polycrystalline silicon.

2. In the mechanical fracturing process, it is inevitable to generate enormous debris and micro powder, thus lowering yield and affecting the quality of polycrystalline silicon and enterprise benefit badly.

3. The debris and micro powder generated in the fracturing process may pollute the environment and are detrimental to employee's health, besides, tiny dust is inflammable and explosive in the air, which constitutes a hidden danger.

In addition, the traditional methods for fracturing polycrystalline silicon can hardly achieve effective control over the sizes of fractured polycrystalline silicon. However, the sizes of fractured polycrystalline silicon are of great importance for a polycrystalline silicon production enterprise, and the reasons therefor are explained as follows. For polycrystalline silicon before being fractured, it typically is a cylindrical polycrystalline silicon rod with a diameter of 80~200 mm, a length of 200~2800 mm and a smooth surface or a surface with nodules thereon, or a polycrystalline silicon lump with a linear dimension of 80~300 mm. However, fractured polycrystalline silicon has irregular shapes and randomly distributed sizes. According to the relevant national standard, the distribution range of sizes of fractured polycrystalline silicon is specified as follows: polycrystalline silicon with a linear dimension of 6~25 mm takes up 15% of total weight at most; polycrystalline silicon with a linear dimension of 25~50 mm takes up 15%~35% of total weight; and polycrystalline silicon with a linear dimension of 50~100 mm takes up 65% of total weight at least. In other words, a linear dimension of 50~100 mm is the optimum size for the fractured polycrystalline silicon. As it is inevitable to generate some small-size silicon lumps in the process of fracturing polycrystalline silicon, only a small amount of polycrystalline silicon with a linear dimension of 6~25 mm is allowed.

SUMMARY OF THE INVENTIONS

In view of the above disadvantages existing in the prior art, the technical problem to be solved by the present invention is to provide a method and an apparatus for fracturing polycrystalline silicon, with which the polycrystalline silicon can be fractured uniformly, less powder is generated, no metal contamination occurs and the fractured polycrystalline silicon is of high quality.

A technical solution used to solve the technical problems of the present invention is a method for fracturing polycrystalline silicon, comprising steps of placing the polycrystalline silicon in a water tank containing water; and applying an instant high voltage to the water tank so that high-voltage discharge occurs in the water of the water tank, to fracture the polycrystalline silicon.

In other words, in the present invention, high-voltage electrostatic discharge occurs fiercely in the water tank, as a result of a drastic change in pressure caused by hydroelectric effect (impulsive discharge) in a closed liquid container. The intense shock wave generated by such discharge can break up the polycrystalline silicon in the water tank, thus solving the problem of severe contamination caused to the polycrystalline silicon products and a large amount of powder in the traditional fracturing methods.

Here, the step of applying an instant high voltage to the water tank specifically comprises steps of:

a. charging a charging capacitor; and b. continuing charging the charging capacitor until voltage of the charging capacitor reaches a breakdown voltage of a disconnecting switch, such that the disconnecting switch is broken down and all voltage stored in the charging capacitor is applied to the water tank.

Preferably, the breakdown voltage of the disconnecting switch is in a range of 30~200 kV.

Preferably, a discharge gap of the disconnecting switch is in a range of 10~50 mm, and a discharge gap of the water tank is in a range of 30~80 mm.

Preferably, in the step of a, charging a charging capacitor is specifically implemented by charging the charging capacitor with alternating current which has been converted by a high-voltage transformer.

Preferably the step of placing the polycrystalline silicon in a water tank containing water specifically comprises step of:

filling water in the water tank, then placing the polycrystalline silicon in the water such that the polycrystalline silicon is submerged in the water.

Further preferably, the water in the water tank takes up ½~¾ of a volume of the water tank.

Preferably, intensity of electric field generated by the instant high voltage is greater than or equal to a critical electric field intensity of the water in the water tank.

Preferably, pure water is adopted as the water in the water tank. By placing and fracturing the polycrystalline silicon in pure water with an extremely low content of metal ions, the polycrystalline silicon is prevented from contacting with metal, thus lowering the possibility of the contamination of the polycrystalline silicon, and ensuring the quality of the fractured polycrystalline silicon.

Further preferably, an electrical resistivity of the water in the water tank is no less than 16.2 MΩ·cm, content of $SiO_2$ is no greater than 10 μg/L, content of Fe is no greater than 1.0 μg/L, content of Ca is no greater than 1.0 μg/L, content of Na is no greater than 20 μg/L, and content of Mg is no greater than 1.0 g/L.

The present invention further provides an apparatus for fracturing polycrystalline silicon, comprising a high-voltage transformer, a high-voltage rectifier, a charging capacitor, a disconnecting switch, a water tank containing water, and a first electrode and a second electrode which are submerged in the water tank, the first electrode and the second electrode being disposed with a certain distance therebetween, wherein a primary winding of the high-voltage transformer is connected to mains supply, a first terminal of a secondary winding of the high-voltage transformer is sequentially connected to the high-voltage rectifier, the disconnecting switch and the first electrode, a second terminal of the secondary winding is grounded and connected to the second electrode, and the charging capacitor is connected between a common terminal of the high-voltage rectifier and the disconnecting switch and a common terminal of the secondary winding and the second electrode.

Here, a high-voltage pulse capacitor (charging capacitor) is charged through an electrostatic high-voltage power supply (high-voltage transformer) until the charging voltage reaches the breakdown voltage of the disconnecting switch, so that the disconnecting switch is broken down, and all of the energy stored in the high-voltage pulse capacitor during charging is applied to the water tank (with the main discharge gap). The value of the charging voltage applied to the high-voltage pulse capacitor by the electrostatic high-voltage power supply, as well as the intensity of the hydroelectric effect, can be controlled through the disconnecting switch (with the auxiliary gap). When the intensity of the electric field between the first electrode and the second electrode in the water tank is greater than the critical breakdown electric field intensity, intense electrostatic high-voltage discharge occurs in the water tank, that is, the main discharge gap is broken down.

Preferably, a charging resistor is connected in series between the high-voltage rectifier and the high-voltage transformer to regulate and stabilize current and voltage in a circuit in which the charging resistor is.

Preferably, a screen mesh is provided at the bottom of the water tank, and a hole size of the screen mesh is in a range of 25~100 mm.

Preferably, a discharge gap of the disconnecting switch is in a range of 10~50 mm, a breakdown voltage of the disconnecting switch is in a range of 30~200 kV, and a discharge gap of the water tank is in a range of 30~80 mm.

Preferably, an electrical resistivity of the water in the water tank is no less than 16.2 MΩ·cm, content of $SiO_2$ is no greater than 10 μg/L, content of Fe is no greater than 1.0 μg/L, content of Ca is no greater than 1.0 μg/L, content of Na is no greater than 20 μg/L, and content of Mg is no greater than 1.0 g/L.

The method for fracturing polycrystalline silicon is a method in which the polycrystalline silicon is fractured by using the hydroelectric effect, and can solve the problems caused by the mechanically fracturing methods in the prior art. The method has disadvantages of uniform fragments, less powder, less metal contamination, and improved quality of polycrystalline silicon. Besides, the method of the present invention can control the sizes of fractured polycrystalline silicon, thereby the method of the present invention can be applied in fracturing polycrystalline silicon on a large scale.

The present invention can control the fracturing effect of polycrystalline silicon (i.e. the sizes of the fractured polycrystalline silicon) by adjusting parameters such as the discharging voltage of the charging capacitor, the main discharge gap, the auxiliary discharge gap, and the like. By selecting the optimum values of the above parameters, the optimum size of the fractured polycrystalline silicon can be ensured, and the amount of the generated powder is reduced.

Specifically, the beneficial effects of the present invention are as follows.

1. The method for fracturing polycrystalline silicon provided by the present invention breaks the conventional methods for fracturing polycrystalline silicon, has simple process and can realize a large-scale fracturing production, as the polycrystalline silicon is fractured by using hydroelectric effect. 2. The method of the present invention can avoid the problem of metal contamination in the process of fracturing polycrystalline silicon in the prior art, fracture polycrystalline silicon uniformly, and reduce the forming of polycrystalline silicon powder effectively, which have critical significance in improving the benefit of an enterprise. 3. The method for fracturing polycrystalline silicon provided by the present invention can achieve effective control over the linear dimension of the fractured polycrystalline silicon, and improve the quality of polycrystalline silicon eventually. 4. The structure of the apparatus for fracturing polycrystalline silicon provided by the present invention is simple, secure, and easy to operate.

A comparison of fracturing effects between the method for fracturing polycrystalline silicon according to the present invention and a manually fracturing method may refer to Table 1 as below.

TABLE 1

| Method for fracturing | Size of polycrystalline silicon (mm) | | Distribution of fractured polycrystalline silicon |
|---|---|---|---|
| | Before fracturing | After fracturing | |
| Method of the present invention | 130 | 0-68 | 0-15 mm: 1%; 15-25 mm: 2.5%; 25-70 mm: 96.5% |
| Manually fracturing method | 130 | 0-66 | 0-15 mm: 9%; 15-25 mm: 16%; 25-70 mm: 75% |

It can be seen from the above Table 1 that, compare to the manually fracturing method, more uniform particles of polycrystalline silicon are obtained, and the sizes of most polycrystalline silicon particles are concentrated in a range of 25~70 mm in the method of fracturing polycrystalline silicon according to the present invention

BRIEF DESCRIPTION OF THE DRAWINGS

FIG. 1 is a schematic diagram illustrating a structure of an apparatus for fracturing polycrystalline silicon according to the present invention.

Reference numerals: 1—first electrode, 2—second electrode, B—high-voltage transformer, G—high-voltage rectifier, R—charging resistor, C—charging capacitor, K—disconnecting switch, F—water tank.

DETAILED DESCRIPTION OF THE EMBODIMENTS

To make those skilled in the art better understand the technical solutions of the present invention, the present invention will be further described in detail in conjunction with the accompanying drawings and the specific implementations The present invention provides a method for fracturing polycrystalline silicon which comprises the steps of:

placing polycrystalline silicon in a water tank containing water;

applying an instant high voltage to the water tank so that high-voltage discharge occurs in the water of the water tank, to fracture the polycrystalline silicon.

Here, the intensity of the electric field generated by the instant high voltage applied to the water tank is greater than or equal to the critical electric field intensity of the water in the water tank, wherein the critical electric field intensity is the lowest electric field intensity that deprives the medium (water) of insulating property.

Preferably, as the water in the water tank, pure water is adopted.

Here, in the pure water, the electrical resistivity of the water is no less than 16.2 MΩ·cm, the content of $SiO_2$ is no greater than 10 μg/L, the content of Fe is no greater than 1.0 μg/L, the content of Ca is no greater than 1.0 μg/L, the content of Na is no greater than 20 μg/L, and the content of Mg is no greater than 1.0 g/L.

This is because the quality index of polycrystalline silicon includes content of surface metal impurities, for example, the content of surface metal impurities of electronic-grade polycrystalline silicon is required to be less than 15 ppbw (ppbw stands for parts per billion by weight). In the method for fracturing polycrystalline silicon of the present invention, when fracturing polycrystalline silicon, the polycrystalline silicon needs to be placed in the water, therefore the metal impurities in the residual water, which generally remains on the surface of the fractured polycrystalline silicon taken out from the water in the water tank, remains on the surface of the polycrystalline silicon after drying. It is assumed that the thickness of water film is d, the linear dimension of the fractured polycrystalline silicon lump is D, and the concentration of metal impurities in the water is C, then the content of the surface metal impurities is about d×C/D, that is, the content of the residual metal impurities on the surface of polycrystalline silicon (due to the residual water) is in direct proportion to the concentration of the metal impurities in the water. Therefore, the contamination of polycrystalline silicon due to the water can be reduced in the process of fracturing by using pure water with low content of metal ions.

The present invention further provides an apparatus for fracturing polycrystalline silicon, which comprises a high-voltage transformer, a high-voltage rectifier, a charging capacitor, a disconnecting switch, a water tank containing water, and a first electrode and a second electrode which are submerged in the water, the first electrode and the second electrode being disposed with a certain distance therebetween, and the distance between the first and second electrodes being a discharge gap of the water tank, wherein a primary winding of the high-voltage transformer is connected to mains supply, a first terminal of a secondary winding of the high-voltage transformer is sequentially connected to the high-voltage rectifier, the disconnecting switch and the first electrode, a second terminal of the secondary winding is grounded and connected to the second electrode, and the charging capacitor is connected between a common terminal of the high-voltage rectifier and the disconnecting switch and a common terminal of the secondary winding and the second electrode.

Embodiment 1:

The present invention provides an apparatus for fracturing polycrystalline silicon, as shown in FIG. 1, the apparatus comprises a high-voltage transformer B, a charging resistor R, a high-voltage rectifier G, a charging capacitor C, a disconnecting switch K, a water tank F, and a first electrode 1 and a second electrode 2 which are submerged in the water, wherein the water tank F contains water, and the first electrode and the second electrode are disposed opposite to each other in the water tank.

Here, a primary winding of the high-voltage transformer B is connected to mains supply, a first terminal of a secondary winding of the high-voltage transformer is sequentially connected to the charging resistor R, the high-voltage rectifier G, the disconnecting switch K and the first electrode 1, a second terminal of the secondary winding is grounded and connected to the second electrode 2, and the charging capacitor C is connected between a common terminal of the high-voltage rectifier G and the disconnecting switch K and a common terminal of the secondary winding and the second electrode 2. In other words, one terminal of the charging capacitor is connected to the common end of the high-voltage rectifier G and the disconnecting switch K, and the other terminal of the charging capacitor is connected to the second terminal of the secondary winding.

Here, the capacitance of the charging capacitor may be selected based on the energy required for breaking the polycrystalline silicon into fragments of desired sizes, which can be calculated according to the formula: discharge energy $E=0.5\ U^2C$. In the above formula, U denotes discharging voltage, and C denotes high-voltage pulse capacitance. In general, discharge energy varies in a range of 1~100 kJ, and preferably in a range of 4~32 kJ, thereby according to the above formula, the capacitance of the charging capacitor may be selected based on an upper limit of the discharge energy and an upper limit of the discharging voltage. For example, when the upper limit of the discharge energy E is set as 20 kJ and the upper limit of the voltage-adjusting range is 200 kV (i.e. the breakdown voltage of the disconnecting switch is 200 kV), the capacitance of the charging capacitor C is $C=2\ E/U^2=1$ μF. As another example, when the upper limit of the discharge energy E is set as 8 kJ and the upper limit of the voltage-adjusting range is 20 kV (i.e. the breakdown voltage of the disconnecting switch is 20 kV), the capacitance of the charging capacitor C is $C=2\ E/U^2=40$ g. In this embodiment, the capacitance of the charging capacitor is 0.5 F.

Here, the discharge gap (i.e. auxiliary discharge gap) of the disconnecting switch is mainly used for isolation, and in the present invention, there are some requirements for the selection of the auxiliary discharge gap, since isolation effect cannot be achieved with a too small auxiliary discharge gap, and breakdown effect cannot be realized within a specified voltage range with a too large auxiliary discharge gap. Also, there are some requirements for the selection of the discharge gap of the water tank (i.e. main discharge gap), since a too small main discharge gap may give rise to electrode erosion, and a too large main discharge gap requires a greatly increased critical breakdown voltage of the main discharge gap, such that the voltage level and the insulation level of the entire electrical equipment are increased, thus pushing up the cost for fracturing eventually.

Moreover, it is necessary to ensure that the critical breakdown voltage of the auxiliary discharge gap should be larger than that of the main discharge gap. In this way, the main discharge gap is broken down as soon as the auxiliary discharge gap is broken down, thus achieving an instant (on the order of μs) discharging. If the main discharge gap cannot be broken down, relevant parameters need to be adjusted, for example, the auxiliary discharge gap is increased, or the main discharge gap is decreased, or both gaps are adjusted at the same time.

Preferably, the discharge gap of the disconnecting switch (i.e. auxiliary discharge gap) is in a range of 10~50 mm, the breakdown voltage of the disconnecting switch is in a range of 30~200 kV and the discharge gap of the water tank (i.e. main discharge gap) is in a range of 30~80 mm.

As the water in the water tank F, pure water is adopted, in which the electrical resistivity of the water is no less than 18.2 MΩ·cm, the content of $SiO_2$ is no greater than 10 μg/L, the content of Fe is no greater than 1.0 μg/L, the content of Ca is no greater than 1.0 μg/L, the content of Na is no greater than 20 μg/L, and the content of Mg is no greater than 1.0 g/L.

Preferably, a screen mesh is provided at the bottom of the water tank, and the hole size of the screen mesh is in a range of 25~100 mm. In this way, after one instant high-voltage discharging happens, qualified fractured polycrystalline silicon can be filtered out by the screen mesh, while the fractured polycrystalline silicon with a size larger than the hole size of the screen mesh remains in the water tank for the next fracturing.

Embodiment 2

This embodiment provides a method for fracturing polycrystalline silicon which can be implemented by using the apparatus in Embodiment 1.

The method comprises the steps of:

step 1: filling the water tank with water taking up approximately ½~¾ of the volume of the water tank, then placing the polycrystalline silicon in the water such that the polycrystalline silicon is submerged in the water;

step 2: applying an instant high voltage to the water tank, the intensity of the electric field generated by the instant high voltage being greater than or equal to the critical electric field intensity of the water in the water tank, wherein the specific steps are as follows:

a. The charging capacitor C is charged by the mains supply which has been converted by the high-voltage transformer B and then been rectified by the high-voltage rectifier G;

b. Once the voltage of the charging capacitor reaches the breakdown voltage of the disconnecting switch K, the disconnecting switch K is broken down, and at this point, all of the energy stored in the capacitor C is applied between the first electrode 1 and the second electrode 2 in the water tank;

c. When the intensity of electric field between the first electrode 1 and the second electrode 2 is greater than or equal to the critical electric field intensity of the water in the water tank, the strong shock wave generated by the high-voltage electrostatic discharge occurring drastically in the water tank F can fracture the polycrystalline silicon instantly; and d. Steps a~c are repeated until all of the polycrystalline silicon is fractured; and Step 3: taking out the fractured polycrystalline silicon and drying the same.

In the embodiment, the discharge gap of the disconnecting switch (i.e. auxiliary discharge gap) is 20 mm, the discharge gap of the water tank F (i.e. main discharge gap) is 50 mm, and the breakdown voltage of the disconnecting switch varies in the range of 30~200 kV. The resulting fracturing effect of polycrystalline silicon by using the method is illustrated in table 2.

TABLE 2

| Breakdown voltage of disconnecting switch (kV) | Main discharge gap (mm) | Auxiliary discharge gap (mm) | Average particle size of polycrystalline silicon (mm) | | Distribution of fractured polycrystalline silicon |
|---|---|---|---|---|---|
| | | | Before fracturing | After fracturing | |
| 30 | 50 | 20 | 130 | 0-98 | 0-25 mm: 3%; 25-50 mm: 4%; 50-100 mm: 77%; above 100 mm: 16% |
| 80 | 50 | 20 | 130 | 0-84 | 0-25 mm: 3.5%; 25-50 mm: 5%; 50-100 mm: 91.5% |
| 130 | 50 | 20 | 130 | 0-68 | 0-25 mm: 12.5%; 25-50 mm: 20%; 50-100 mm: 67.5% |
| 180 | 50 | 20 | 130 | 0-60 | 0-25 mm: 16%; 25-50 mm: 25%; 50-100 mm: 59% |
| 200 | 50 | 20 | 130 | 0-48 | 0-25 mm: 21%; 25-50 mm: 36.5%; 50-100 mm: 43.5%; |

Table 2 illustrates the fracturing effect of polycrystalline silicon in the case that the main discharge gap and the auxiliary discharge gap remain unchanged and the breakdown voltage of the disconnecting switch is increased gradually. It can be inferred from Table 2 that the linear dimension of the fractured polycrystalline silicon decreases as the breakdown voltage of the disconnecting switch increases. It is thus obvious that the breakdown voltage of the disconnecting switch is a key factor that affects the fracturing effect of polycrystalline silicon.

It should be noted that the method in the embodiment can also be implemented by using other apparatuses, not limited to the apparatus illustrated in the embodiment.

Embodiment 3

This embodiment provides a method for fracturing polycrystalline silicon which can be implemented by using the apparatus in Embodiment 1.

The steps in the method of the embodiment are basically the same as those in Embodiment 2, except that in the embodiment, the breakdown voltage of the disconnecting switch is 80 kV, the discharge gap of the water tank F (i.e. main discharge gap) is 50 mm, and the discharge gap of the disconnecting switch (i.e. auxiliary discharge gap) varies in the range of 10~50 mm. The resulting fracturing effect of polycrystalline silicon by using the method is illustrated in Table 3.

TABLE 3

| Breakdown voltage of disconnecting switch (kV) | Main discharge gap (mm) | Auxiliary discharge gap (mm) | Average particle size of polycrystalline silicon (mm) | | Distribution of fractured polycrystalline silicon |
|---|---|---|---|---|---|
| | | | Before fracturing | After fracturing | |
| 80 | 50 | 10 | 130 | 0-90 | 0-25 mm: 3%; 25-50 mm: 5%; 50-100 mm: 84%; above100 mm: 8% |
| 80 | 50 | 20 | 130 | 0-84 | 0-25 mm: 3.5%; 25-50 mm: 5%; 50-100 mm: 91.5% |
| 80 | 50 | 30 | 130 | 0-81 | 0-25 mm: 4.5%; 25-50 mm: 8%; 50-100 mm: 87.5% |
| 80 | 50 | 40 | 130 | 0-78 | 0-25 mm: 8%; 25-50 mm: 11%; 50-100 mm: 81% |
| 80 | 50 | 50 | 130 | 0-73 | 0-25 mm: 15%; 25-50 mm: 13.5%; 50-100 mm: 71.5%; |

Table 3 illustrates the fracturing effect of polycrystalline silicon in the case that the main discharge gap and the breakdown voltage of the disconnecting switch remain unchanged and the auxiliary discharge gap is increased gradually. It can be inferred from Table 3 that the linear dimension of the fractured polycrystalline silicon decreases as the auxiliary discharge gap increases. It is thus obvious that the auxiliary discharge gap is a key factor that affects the fracturing effect of polycrystalline silicon.

Embodiment 4

This embodiment provides a method for fracturing polycrystalline silicon which can be implemented by using the apparatus in Embodiment 1.

The steps in the method of the embodiment are basically the same as those in Embodiment 2, except that, in the embodiment, the discharge gap of the disconnecting switch (i.e. auxiliary discharge gap) remains 20 mm, the breakdown voltage of the disconnecting switch varies in the range of 30~200 mm, and meanwhile the discharge gap of the water tank F (i.e. main discharge gap) varies in the range of 30~80 mm. The resulting fracturing effect of polycrystalline silicon by using the present method is illustrated in Table 4.

TABLE 4

| Breakdown voltage of disconnecting switch (kV) | Main discharge gap (mm) | Auxiliary discharge gap (mm) | Average particle size of polycrystalline silicon (mm) | | Distribution of fractured polycrystalline silicon |
|---|---|---|---|---|---|
| | | | Before fracturing | After fracturing | |
| 30 | 30 | 20 | 130 | 0-92 | 0-25 mm: 3%; 25-50 mm: 5.5%; 50-100 mm: 76.5%; above 100 mm: 15% |
| 80 | 50 | 20 | 130 | 0-84 | 0-25 mm: 3.5%; 25-50 mm: 5%; 50-100 mm: 91.5% |

TABLE 4-continued

| Breakdown voltage of disconnecting switch (kV) | Main discharge gap (mm) | Auxiliary discharge gap (mm) | Average particle size of polycrystalline silicon (mm) Before fracturing | After fracturing | Distribution of fractured polycrystalline silicon |
|---|---|---|---|---|---|
| 130 | 60 | 20 | 130 | 0-80 | 0-25 mm: 8%; 25-50 mm: 10%; 50-100 mm: 82% |
| 180 | 70 | 20 | 130 | 0-78 | 0-25 mm: 11%; 25-50 mm: 12%; 50-100 mm: 77% |
| 200 | 80 | 20 | 130 | 0-76 | 0-25 mm: 13%; 25-50 mm: 14%; 50-100 mm: 73%; |

Table 4 illustrates the fracturing effect of polycrystalline silicon in the case that the auxiliary discharge gap maintains unchanged and both the main discharge gap and the breakdown voltage of the disconnecting switch are increased gradually. It can be inferred from Table 3 that the linear dimension of the fractured polycrystalline silicon decreases gradually.

In addition, it can be seen from a comparison between the fracturing effects in Table 4 and Table 2 that, the linear dimension of the fractured polycrystalline silicon in Table 2 is smaller than that in Table 4 under the condition of the same breakdown voltage of the disconnecting switch, the same auxiliary discharge gap, and different main discharge gap. Therefore, it can be concluded that the linear dimension of the fractured polycrystalline silicon decreases as the breakdown voltage of the disconnecting switch increases; the linear dimension of the fractured polycrystalline silicon increases as the main discharge gap increases; and the breakdown voltage of the disconnecting switch has a greater impact on the fracturing effect of polycrystalline silicon than the main discharge gap in a state with experimental parameters in Table 4.

It should be understood that above implementations are merely exemplary implementations used to explain the principle of the present invention, however, the present invention are not limited thereto. Various modifications and improvements may be made by those skilled in the art without departing from the spirit and substance of the present invention, and such modifications and improvements are also deemed as the protection scope of the present invention.

The invention claimed is:

1. A method for fracturing polycrystalline silicon, comprising steps of placing the polycrystalline silicon in a water tank containing water; and applying an instant high voltage to the water tank so that high-voltage discharge occurs in the water of the water tank, to fracture the polycrystalline silicon;

wherein the step of applying an instant high voltage to the water tank comprises steps of:

charging a charging capacitor; and continuing charging the charging capacitor until voltage of the charging capacitor reaches a breakdown voltage of a disconnecting switch, so that the disconnecting switch is broken down and all voltage stored in the charging capacitor is applied to the water tank;

wherein the breakdown voltage of the disconnecting switch is in a range of 30~200 kV;

wherein the polycrystalline silicon before being fractured is a cylindrical polycrystalline silicon rod with a diameter of 80~200 mm, a length of 200~2800 mm; and wherein the fractured polycrystalline silicon has irregular shapes, and the distribution range of sizes of the fractured polycrystalline silicon is specified as follows: the polycrystalline silicon with a linear dimension of 0~25 mm takes up 3-21% of total weight; the polycrystalline silicon with a linear dimension of 25~50 mm takes up 4%~36.5% of total weight; and the polycrystalline silicon with a linear dimension of 50~100 mm takes up 43.5%~91.5% of total weight.

2. The method according to claim 1, wherein a discharge gap of the disconnecting switch is in a range of 10~50 mm, and a discharge gap of the water tank is in a range of 30~80 mm.

3. The method according to claim 1, wherein in the step of charging a charging capacitor is specifically implemented by charging the charging capacitor with alternating current which has been converted by a high-voltage transformer.

4. The method according to claim 1, wherein the step of placing the polycrystalline silicon in a water tank containing water comprises:

filling water in the water tank, then placing the polycrystalline silicon in the water such that the polycrystalline silicon is submerged in the water.

5. The method according to claim 1, wherein the water in the water tank takes up ½~¾ of the volume of the water tank.

6. The method according to claim 1, wherein intensity of electric field generated by the instant high voltage is greater than or equal to a critical electric field intensity of the water in the water tank.

7. The method according to claim 1, wherein pure water is adopted as the water in the water tank.

8. The method according to claim 7, wherein an electrical resistivity of the water in the water tank is no less than 16.2 MΩ·cm, content of $SiO_2$ is no greater than 10 μg/L, content of Fe is no greater than 1.0 μg/L, content of Ca is no greater than 1.0 μg/L, content of Na is no greater than 20 μg/L, and content of Mg is no greater than 1.0 g/L.

9. The method according to claim 1, wherein the polycrystalline silicon rod has a smooth surface.

10. The method according to claim 1, wherein the polycrystalline silicon rod has a surface with nodules thereon.

11. A method for fracturing polycrystalline silicon, comprising steps of placing the polycrystalline silicon in a water tank containing water; and applying an instant high voltage to the water tank so that high-voltage discharge occurs in the water of the water tank, to fracture the polycrystalline silicon;

wherein the step of applying an instant high voltage to the water tank comprises steps of:

charging a charging capacitor; and continuing charging the charging capacitor until voltage of the charging capacitor reaches a breakdown voltage of a disconnecting switch, so that the disconnecting switch is broken down and all voltage stored in the charging capacitor is applied to the water tank;

wherein the breakdown voltage of the disconnecting switch is in a range of 30~200 kV;

wherein the polycrystalline silicon before being fractured is a silicon lump with a linear dimension of 80~300 mm; and wherein the fractured polycrystalline silicon has irregular shapes, and the distribution range of sizes of the fractured polycrystalline silicon is specified as follows: the polycrystalline silicon with a linear dimension of 0~25 mm takes up 3-21% of total weight; the polycrystalline silicon with a linear dimension of 25~50 mm takes up 4%~36.5% of total weight; and the polycrystalline silicon with a linear dimension of 50~100 mm takes up 43.5%~91.5% of total weight.

* * * * *